US006482071B1

(12) United States Patent
Wilgosz

(10) Patent No.: US 6,482,071 B1
(45) Date of Patent: Nov. 19, 2002

(54) LIGHTED COIL SPRING AMUSEMENT DEVICE

(76) Inventor: Robert Wilgosz, 252 S. Broad St., Woodbury, NJ (US) 08096

( * ) Notice: Subject to any disclaimer, the term of this patent is extended or adjusted under 35 U.S.C. 154(b) by 0 days.

(21) Appl. No.: 09/931,567

(22) Filed: Aug. 17, 2001

(51) Int. Cl.[7] ..... A63H 33/00
(52) U.S. Cl. ..... 446/486; 446/175
(58) Field of Search ..... 446/397, 176, 446/213, 486, 491, 404, 484, 188, 175; 482/74, 84, 900

(56) References Cited

U.S. PATENT DOCUMENTS 3,817,595 A * 6/1974 Edelman et al. ..... 156/173
D234,789 S 4/1975 Rosenberg
4,078,330 A * 3/1978 Roth ..... 446/26
4,114,306 A 9/1978 Molenaar
4,848,009 A 7/1989 Rodgers
5,431,591 A * 7/1995 Muzzi ..... 446/397
5,692,737 A * 12/1997 Perlsweig ..... 267/168
6,000,991 A * 12/1999 Truchsess et al. ..... 446/397

* cited by examiner

*Primary Examiner*—Jacob K. Ackun
*Assistant Examiner*—Bena B. Miller
(74) *Attorney, Agent, or Firm*—Norman E. Lehrer

(57) ABSTRACT

A coil spring amusement device which includes a spring with a plurality of connected rings, a right end, a left end, and light devices attached to right and left ends, respectively is disclosed. Each light device includes a plurality of light emitting diodes (LED's); a power source for energizing the diodes; a circuit for selectively electrically connecting the power source with the diodes; and a switch responsive to the motion of the spring for causing the circuit to connect the power source to the diodes in order to illuminate the diodes. The light device also has a clip by which it is secured to the spring.

4 Claims, 2 Drawing Sheets

LIGHTED COIL SPRING AMUSEMENT DEVICE

BACKGROUND OF THE INVENTION

The present invention is directed toward a coil spring amusement device and more particularly, toward a coil spring toy with an electronic flashing light which illuminates when the toy moves.

A coil spring toy which may be made from metal, plastic, or the like and is easily compressed and stretched by a person is commonly known as a SLINKY. In order to play with the toy it may be held by a person with an end in each hand. The person may then move his or her hands up and down, for example, so that a wave-like motion of the toy is produced. Another popular way to play with the toy is to place the toy at the top of a set of stairs or an inclined surface and to propel the toy down the stairs or surface so that the toy moves down the stairs or surface by traveling end over end. Thus, the toy appears to walk down the stairs or surface.

In order to make this simple toy even more interesting, several variations of the SLINKY have been created. For example, U.S. Pat. No. 6,000,991 to Truchsess et al. discloses a SLINKY which includes an attachment that generates light or sound whenever the moving coil changes direction. However, this attachment is rather large and bulky and may interfere with the movement of the toy and particularly with its ability to walk down stairs.

Also, U.S. Pat. No. 5,431,591 to Muzzi discloses a spring toy with a pressure actuated tone generator connected to an audio transducer so that upon activation, musical notes are played. However, this toy cannot function as a SLINKY.

Therefore, a simple, unobtrusive attachment to a SLINKY which increases the level of amusement of the toy and adds versatility to toys of this type is needed.

SUMMARY OF THE INVENTION

The present invention is designed to overcome the deficiencies of the prior art discussed above. It is an object of the present invention to provide a coil spring amusement device with electronic flashing lights.

It is another object of the present invention is to provide a coil spring amusement device with a light which is activated when the device moves.

A further object of the present invention to provide a coil spring toy with a light device which is small, light in weight, and has little effect on the operation of the toy.

In accordance with the illustrative embodiments demonstrating features and advantages of the present invention, there is provided a coil spring amusement device which includes a spring with a plurality of connected rings, a right end, a left end, and light devices attached to right and left ends, respectively. Each light device includes a plurality of light emitting diodes (LED); a power source for energizing the diodes; a circuit for selectively electrically connecting the power source with the diodes; and means responsive to the motion of the spring for causing the circuit to connect the power source to the diodes in order to illuminate the LED. The light device also has a clip by which it is secured to the spring within the interior thereof so as not to interfere with the operation of the toy.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
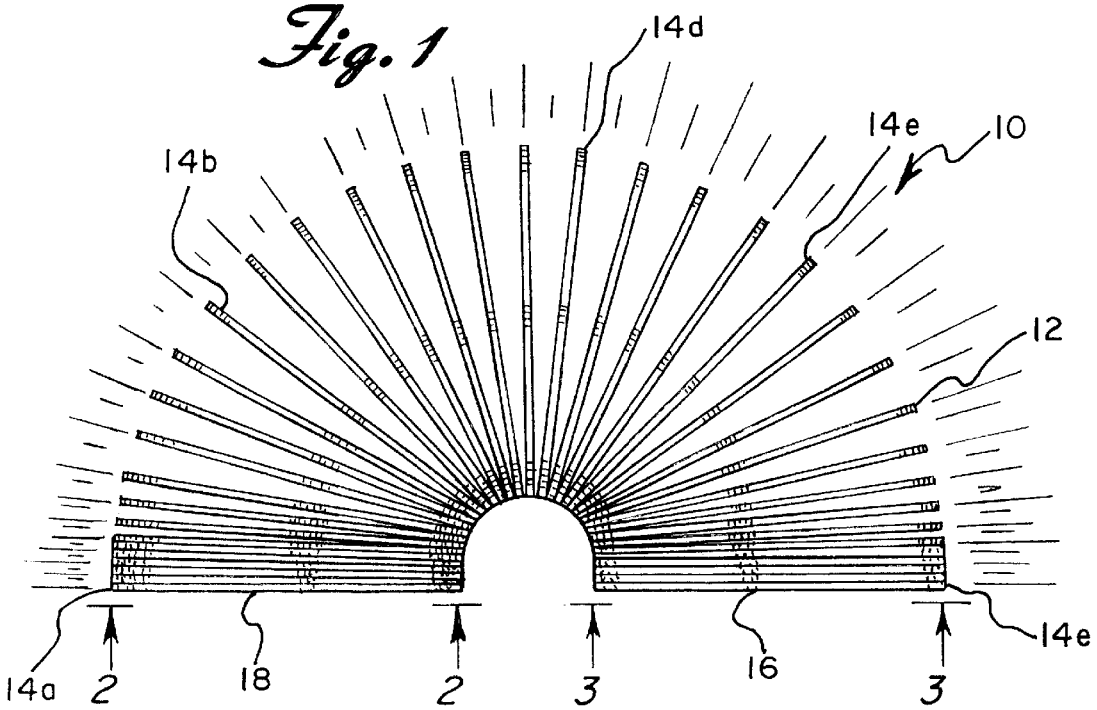
FIG. 1 is a perspective view of the coil spring toy of the present invention.

Referring now to the drawings in detail wherein like reference numerals have been used throughout the various figures to designate like elements, there is shown in FIG. 1 a coil spring toy constructed in accordance with the principles of the present invention and designated generally as 10.

The coil spring toy of the present invention essentially includes a spring 12 with a plurality of connected rings 14*a*–14*e*, for example, a right end 16, a left end 18, and light devices 20 and 22 attached to right end 16 and left end 18, respectively. It should be realized that while two light devices have been shown, the invention is equally applicable to one or any number of light devices that may be attached to the spring. The coil spring may be made from metal, plastic, or other similar material from which the SLINKY is typically made.

Figure 2:
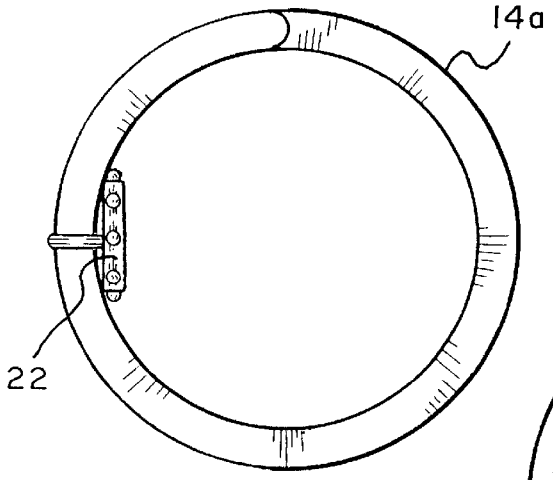
FIG. 2 is a bottom plan view of the present invention taken along line 2—2 of FIG. 1.
Figure 3:
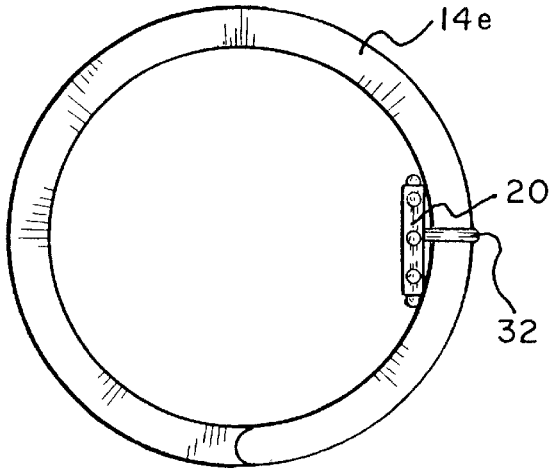
FIG. 3 is a bottom plan view of the present invention taken along line 3—3 of FIG. 1.
Figure 4:
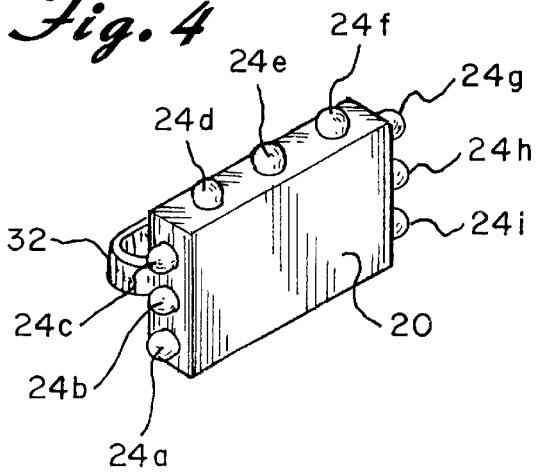
FIG. 4 is a front perspective view of the light device attached to the coil spring toy of the present invention.
Figure 5:
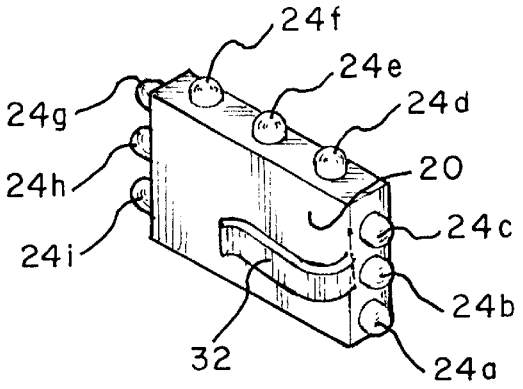
FIG. 5 is a rear perspective view of the light device attached to the coil spring toy of the present invention.
Figure 6:
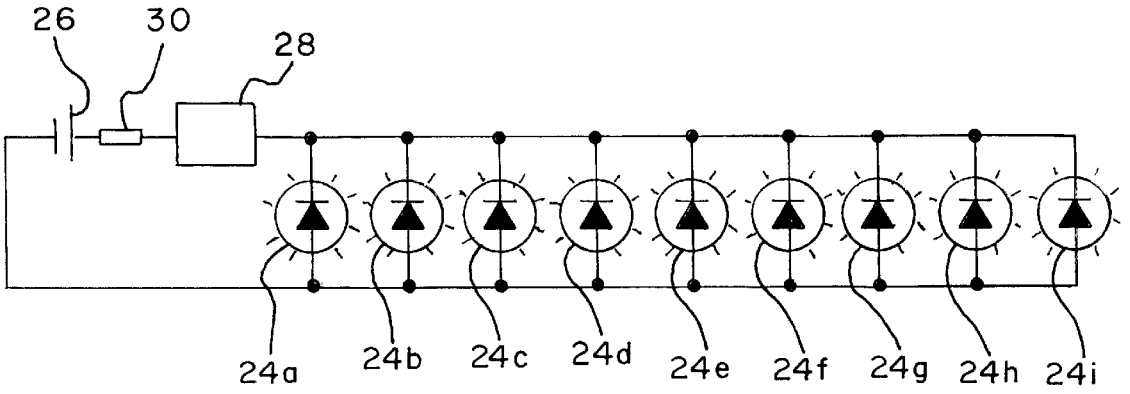
FIG. 6 is a schematic diagram of the circuit of the light device.

While more than one light device may be included in the toy of the present invention, only one will be described as all of the devices are similar in construction. The light device 20 consists of a plurality of light emitting diodes (LED's), shown at 24*a*–24*i*; a power source 26 for energizing the diodes 24*a*–24*i*; a circuit 28 for selectively electrically connecting the power source 26 with the diodes 24*a*–24*i*; and switch means 30 responsive to the motion of the spring 12 for causing the circuit 28 to connect the power source 26 to the diodes 24*a*–24*i* in order to illuminate the diodes 24*a*–24*i*. (See FIG. 6.) The switch means 30 is preferably a mercury switch although substantially any switch capable of sensing motion may also be used. The light device 20 also has a clip 32 or similar means for securing the same to the end of the spring. (See FIGS. 2 and 3.)

As the coil spring 12 moves, in any direction, the switch 30 is activated so that power is supplied to the LED'a 24*a*–24*i* which, in turn, are illuminated. The LED's are not illuminated when the spring stops moving. That is, the switch is not activated when the coil spring is not in motion, thereby preventing power from being supplied to the LED's and illuminating the same. It is, of course, possible to have the electronic circuit 28 maintain the diodes on and or allow them to flash for a period of time after the toy has stopped moving. The circuit may then include a timer which will shortly thereafter turn the diodes off. While not intended to be limited thereto, one circuit that may be useful with the present invention is shown in U.S. Pat. No. 4,848,009, the entire subject matter of which is incorporated herein by reference.

The power source is preferably a small battery such as a watch battery or the like. The LED's may be arranged so that they are activated simultaneously, randomly or sequentially. Or, the lights may be connected to a timer device so that only certain of the lights are activated at a given time. Furthermore, different colored lights may be used. In all cases, however, each of the lighting devices 20 and 22 is small enough to fit within the end of the Slinky so as to be essentially hidden from view from the outside of the Slinky when the LED's are off. The lighting devices are also small and light weight enough so as not to interfere with the normal operation of the Slinky toy. As the toy is used, however, light passes from the inside of the Slinky to the outside thereof as shown in FIG. 1.

The present invention may be embodied in other specific forms without departing from the spirit or essential attributes thereof and accordingly, reference should be made to the appended claims rather than to the foregoing specification as indicating the scope of the invention.

I claim:

1. A coil spring amusement device comprising:

a coil spring having a plurality of connected rings defining an interior, a right end, and a left end;

means for lighting the interior of said coil spring including a plurality of light emitting diodes, a power source for energizing said diodes, a circuit for selectively electrically connecting said power source with said diodes, and means responsive to any motion of said coil spring for causing said circuit to connect said power source to said diodes it order to illuminate said diodes; and means for securing said lighting means to the interior of said coil spring so that said lighting means are located within said interior.

2. The coil spring amusement device of claim 1 wherein said power source is a battery.

3. The coil spring amusement device of claim 1 wherein said securing means includes a clip.

4. The coil spring amusement device of claim 1 wherein said lighting means is secured to both of said ends of said spring coil.

* * * * *